US009380821B2

(12) United States Patent
Martin

(10) Patent No.: US 9,380,821 B2
(45) Date of Patent: Jul. 5, 2016

(54) NECKLINE GUSSET FOR AN APPAREL ITEM

(71) Applicant: Nike, Inc., Beaverton, OR (US)

(72) Inventor: Lindsey V. J. Martin, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 192 days.

(21) Appl. No.: 14/314,322

(22) Filed: Jun. 25, 2014

(65) Prior Publication Data

US 2015/0374054 A1 Dec. 31, 2015

(51) Int. Cl.
*A41D 27/02* (2006.01)
*A41D 3/02* (2006.01)

(52) U.S. Cl.
CPC *A41D 27/02* (2013.01); *A41D 3/02* (2013.01); *A41D 2300/20* (2013.01)

(58) Field of Classification Search
CPC ..... A41D 27/04; A41D 3/00; A41D 27/02; A41D 3/02; A41B 3/00
See application file for complete search history.

(56) References Cited

U.S. PATENT DOCUMENTS 2,441,122 A 5/1948 Sturz
2,517,289 A 8/1950 Davis
2,571,255 A * 10/1951 Kessler ..... A41D 27/04 2/97
2,582,772 A * 1/1952 Egbert ..... A41D 3/00 2/103
D520,712 S * 5/2006 Wyatt ..... D2/500
2003/0167551 A1* 9/2003 Findlay ..... A41D 3/02 2/93

FOREIGN PATENT DOCUMENTS

GB 561640 A 5/1944

OTHER PUBLICATIONS

International Search Report with Written Opinion dated Sep. 7, 2015 in Application No. PCT/US2015/036934, 12 pages.

* cited by examiner

*Primary Examiner* — Anna Kinsaul
(74) *Attorney, Agent, or Firm* — Shook, Hardy & Bacon L.L.P.

(57) ABSTRACT

A neckline gusset for securing an exterior shell layer of an apparel item to an inner liner layer of the apparel item at a neckline region of the apparel item is provided. The neckline gusset comprises an outer edge corresponding in shape to the neckline of the exterior shell layer, an inner edge corresponding in shape to the neckline of the inner liner layer, a first center-front gusset edge connecting the outer edge to the inner edge at a first end of the neckline gusset, and a second center-front gusset edge connecting the outer edge to the inner edge at a second end of the neckline gusset. The first and second center-front gusset edges curve inwardly into the body of the neckline gusset and form acute angles with both the outer edge and the inner edge of the neckline gusset.

20 Claims, 4 Drawing Sheets

NECKLINE GUSSET FOR AN APPAREL ITEM

STATEMENT REGARDING FEDERALLY SPONSORED RESEARCH OR DEVELOPMENT

Not applicable.

TECHNICAL FIELD

The aspects hereof relate to a neckline gusset for securing an exterior shell layer of an apparel item to an inner liner layer of the apparel item at a neckline region of the apparel item.

BACKGROUND

Coats and jackets that have an exterior shell layer and an inner liner layer are popular choices for outerwear apparel. The exterior shell layer typically provides protection from the elements such as wind and water, while the inner liner layer provides insulation and warmth. In order to provide insulation and warmth, the inner liner layer is generally form-fitting, while the exterior shell layer is generally looser in fit to allow the wearer a greater range of movement.

The inner liner layer may be connected to the exterior shell layer in a number of different ways including by the use of one or more gussets. However, an improperly-shaped gusset may distort the appearance of the outerwear apparel when worn by the wearer by, for example, tugging on portions of the exterior shell layer and/or by bunching-up in certain areas of the apparel item. In addition, improperly-shaped gussets may restrict the wearer's range of movement when wearing the outerwear apparel.

BRIEF SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Aspects generally relate to a neckline gusset used to secure an exterior shell layer of an apparel item to an inner liner layer of the apparel item at a neckline region of the apparel item. As used throughout this disclosure, a gusset may be defined as an inset piece of material used to strengthen or enlarge an apparel item. The neckline gusset is shaped such that the exterior shell layer and the inner liner layer lay properly, without bunching or tugging, at the neckline region when the apparel item is worn thereby promoting the wearer's comfort. Additionally, the end portions of the neckline gusset are adapted to be secured to center-front gussets that connect the inner liner layer to the exterior shell layer at front portions of the apparel item. The end portions of the neckline gusset may have a flared (e.g., concave) shape that helps the center-front gussets to fold inwardly and lay without bunching or gathering when the front portions of the apparel item are secured together thus maintaining a smooth appearance to the front of the apparel item. The neckline gusset and the center-front gussets combine to create a substantially sealed volume between the inner liner layer and the exterior shell layer when the apparel item is secured at the front. This not only increases the warmth and insulation characteristics of the apparel item, but protects the wearer from the elements.

Accordingly, aspects of the neckline gusset comprise a textile material having an outer edge adapted to secure the neckline gusset to the exterior shell layer of the apparel item at the neckline region of the apparel item and an inner edge adapted to secure the neckline gusset to the inner liner layer of the apparel item at the neckline region. The spacing between the outer edge and the inner edge at the midline of the neckline gusset may be generally equal to spacing between the exterior shell layer and the inner liner layer at the midline of the neckline region when the apparel item is in a generally as-constructed arrangement but without the neckline gusset in place. Equating these two distances facilitates the inner liner layer, the neckline gusset, and the exterior shell layer to each lie appropriately as if the inner liner layer and the exterior shell layer where independent of each other (e.g., not coupled by the neckline gusset), without bunching or folding, at the neckline region when the apparel item is worn.

The neckline gusset may further comprise a first center-front gusset edge that connects the outer edge to the inner edge at a first end of the neckline gusset. The first center-front gusset edge may be adapted to secure the neckline gusset to a first center-front gusset that connects the inner liner layer with the exterior shell layer at a first front portion of the apparel item. The neckline gusset also comprises a second center-front gusset edge that connects the outer edge to the inner edge at a second end of the neckline gusset. The second center-front gusset edge may be adapted to secure the neckline gusset to a second center-front gusset which, in turn, connects the inner liner layer with the exterior shell layer at a second front portion of the apparel item. The first and second center-front gusset edges have an inwardly-curved (e.g., concave) shape. The curved shape of the first and second center-front gusset edges forms a first acute angle where the center-front gusset edges meet the outer edge of the neckline gusset and a second acute angle where the center-front gusset edges meet the inner edge of the neckline gusset. The configuration of the first and second ends of the neckline gusset facilitates the center-front gussets to fold inwardly and lay without bunching when the front portions of the apparel item are secured together.

BRIEF DESCRIPTION OF THE SEVERAL VIEWS OF THE DRAWINGS

The present invention is described in detail below with reference to the attached drawings figures, wherein.

DETAILED DESCRIPTION

Figure 1:
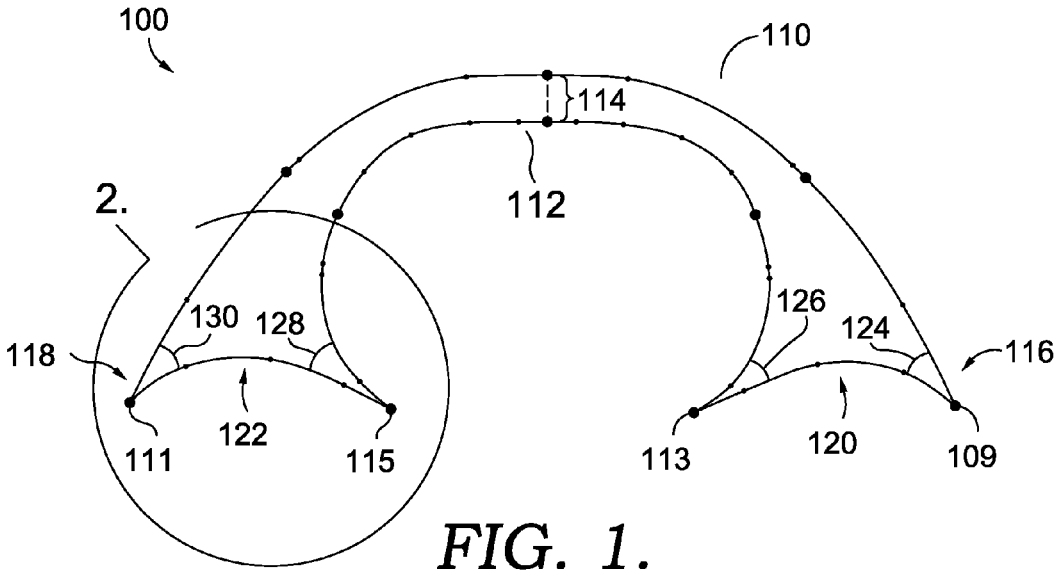
FIG. 1 illustrates a top plan view of an exemplary neckline gusset for reference purposes in accordance with aspects thereof.

Aspects provide for a neckline gusset used to secure an inner liner layer of an apparel item, such as a coat or jacket, to an exterior shell layer of the apparel item at a neckline region of the apparel item. The neckline gusset in accordance with aspects thereof may comprise a knitted or woven textile material having an outer edge adapted to be secured to the exterior shell layer at the neckline region and an inner edge adapted to be secured to the inner liner layer at the neckline region. The shape of the outer edge of the neckline gusset may correspond to the shape of the neckline of the exterior shell layer. As well, the shape of the inner edge of the neckline gusset may correspond to the shape of the neckline of the inner liner layer. The distance between the outer edge and the inner edge taken at a midline of the neckline gusset may be the same as a distance between the neckline of the exterior shell layer and the neckline of the inner liner layer at a midline of the apparel item when the apparel item is in a generally as-constructed arrangement but without the neckline gusset in place. Equating these two distances facilitates the inner liner layer, the neckline gusset, and the exterior shell layer to each lie appropriately as if the inner liner layer and the exterior shell layer where independent of each other (e.g., not coupled by the neckline gusset), without bunching or folding, at the neckline region when the apparel item is worn.

Continuing, both the outer edge and the inner edge of the neckline gusset terminate at a first end and a second end. The neckline gusset may further comprise a first center-front gusset edge that connects the outer edge with the inner edge at the first end of the neckline gusset. The first center-front gusset edge may be adapted to secure the neckline gusset to a first center-front gusset that connects the inner liner layer with the exterior shell layer at a first front portion of the apparel item. The neckline gusset may additionally comprise a second center-front gusset edge that connects the outer edge with the inner edge at the second end of the neckline gusset. The second center-front gusset edge may be adapted to be connected to a second center-front gusset that, in turn, connects the inner liner layer with the exterior shell layer at a second front portion of the apparel item.

The first and second center-front gusset edges may have an inwardly-curved (e.g., concave) shape such that a first acute angle is formed between the center-front gusset edges and the outer edge of the neckline gusset and a second acute angle is formed between the center-front gusset edges and the inner edge of the neckline gusset. The shape of the neckline gusset as described allows the apparel item to lie appropriately along the neckline region of a wearer when the apparel item is being worn. In addition, the shape of the first and second ends of the neckline gusset enables the first and second center-front gussets to fold inwardly and lay appropriately, without bunching, when the two front portions of the apparel item are secured together via, for example, a zipper or other types of closure mechanisms.

FIG. 1 depicts an exemplary neckline gusset 100 that will be described for reference purposes and in accordance with aspects hereof. The neckline gusset 100 comprises an outer edge 110 and an inner edge 112 connected at a first end 116 by a first center-front gusset edge 120 and at a second end 118 by a second center-front gusset edge 122. The neckline gusset 100 is used to secure an exterior shell layer of an apparel item with an inner liner layer of the apparel item at a neckline region of the apparel item. The neckline gusset 100 may be constructed from a variety of textile materials. The textile materials used for the neckline gusset 100 may generally be water-resistant and/or wind-resistant. Exemplary materials may include, for example, tightly-woven or knitted nylon or polyester fabrics, polyurethane laminates, vinyl, fabrics treated with water repellents such as laminated cotton, water-resistant/breathable fabrics (e.g., expanded polytetrafluoroethylene) , and the like. The outer edge 110 of the neckline gusset 100 may have a generally semi-circular shape as shown in FIG. 1. As will be explained below with respect to FIG. 3, the shape of the outer edge 110 mirrors the shape of the exterior shell layer at the neckline region of the apparel item. The outer edge 110 is adapted to be secured to the exterior shell layer at the neckline region of the apparel item. The outer edge 110 terminates at a first terminal end 109 and a second terminal end 111.

The inner edge 112 of the neckline gusset 100 may be generally C-shaped. This shape may correspond generally to the shape of the inner liner layer at the neckline region of the apparel item. Because of the correspondence in shape between the inner edge 112 and the inner liner layer of the apparel item at the neckline region, the inner edge 112 can be secured to the inner liner layer without gathering or bunching at the neckline region. The inner edge 112 of the neckline gusset 100 terminates at a first terminal end 113 and a second terminal end 115. The generally semi-circular shape of the outer edge 110 and the generally C-shaped curve of the inner edge 112 work together to create a flared shape at both of the first end 116 and the second end 118 of the neckline gusset 100. At the midline of the neckline gusset 100, the outer edge 110 is separated from the inner edge 112 by a distance 114.

The first center-front gusset edge 120 connects the first terminal end 109 of the outer edge 110 with the first terminal end 113 of the inner edge 112 Likewise, the second center-front gusset edge 122 connects the second terminal end 111 of the outer edge 110 with the second terminal end 115 of the inner edge 112. As shown in FIG. 1, both the first and second center-front gusset edges 120 and 122 may have a generally inwardly-curved (e.g., concave) shape. In other words, a shape that curves into the body of the neckline gusset 100. The combination of the shape of the outer edge 110, the shape of the inner edge 112, and the curved shapes of the center-front gusset edges 120 and 122 creates acute angles at the junction of the center-front gusset edges 120 and 122 and the outer and inner edges 110 and 112. For example, acute angles 124 and 130 are created at the junction of the first center-front gusset edge 120 and the outer edge 110, and the second center-front gusset edge 122 and the outer edge 110 respectively. Acute angles 126 and 128 are created at the junction of the first center-front gusset edge 120 and the inner edge 112, and the second center-front gusset edge 122 and the inner edge 112 respectively.

Figure 2:
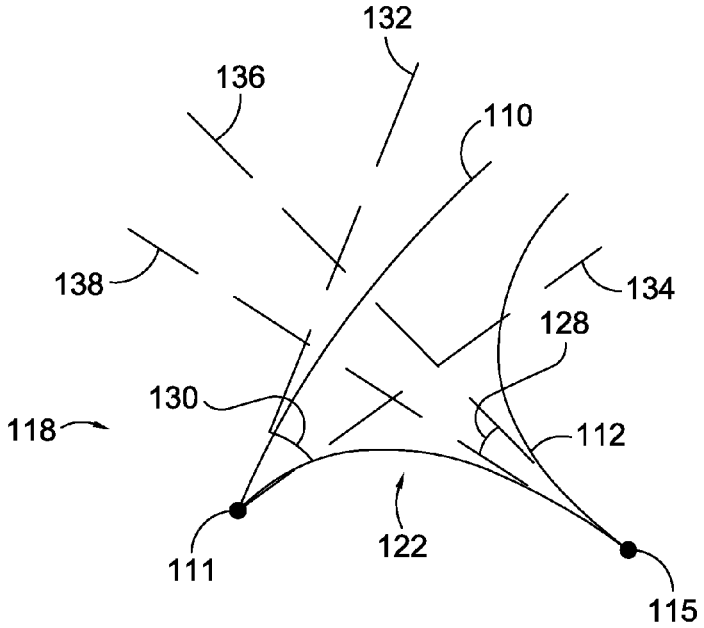
FIG. 2 illustrates an blow-up view of a portion of the exemplary neckline gusset of FIG. 1 taken at the indicated circle depicting how angles associated with the exemplary neckline gusset of FIG. 1 are measured in accordance with aspects thereof.

FIG. 2, which is a blow-up view of the second end 118 of the neckline gusset 100 of FIG. 1 taken at reference circle 2, illustrates how the angles 128 and 130 are measured. The principles illustrated in FIG. 2 are equally applicable to the first end 116 of the neckline gusset 100. As shown in FIG. 2, dashed tangent lines 132 and 134 are drawn from the terminal end 111 of the outer edge 110. Tangent line 132 represents the tangent of the outer edge 110 taken from the terminal end 111, and tangent line 134 represents the tangent of the second center-front gusset edge 122 taken from the terminal end 111. The acute angle 130 is measured between the tangent line 132 and the tangent line 134. Additionally as shown in FIG. 2, dashed tangent lines 136 and 138 are drawn from the terminal end 115 of the inner edge 112. Tangent line 136 represents the tangent of the inner edge 112 taken from the terminal end 115, and the tangent line 138 represents the tangent of the second center-front gusset edge 122 taken from the terminal end 115. The acute angle 128 is measured between the tangent line 136 and the tangent line 138.

With FIG. 2 as a reference, and turning back to FIG. 1, in an exemplary aspect, the acute angles 124 and 126 each measure the same number of degrees, and the acute angles 126 and 128 each measure the same number of degrees. In an exemplary aspect, the acute angles 124 and 126 each measure between 30 to 40 degrees, between 32 and 37 degrees, or between 34 and 36 degrees. In an exemplary aspect, the acute angles 126 and 128 each measure between 10 to 20 degrees, between 12 and 17 degrees, or between 14 and 16 degrees. The coordination of the angles, in an exemplary aspect, allows for the inner liner layer and the exterior shell layer to fit a wearer as intended, which may not be accomplished with alternative angle selections.

Figure 3:
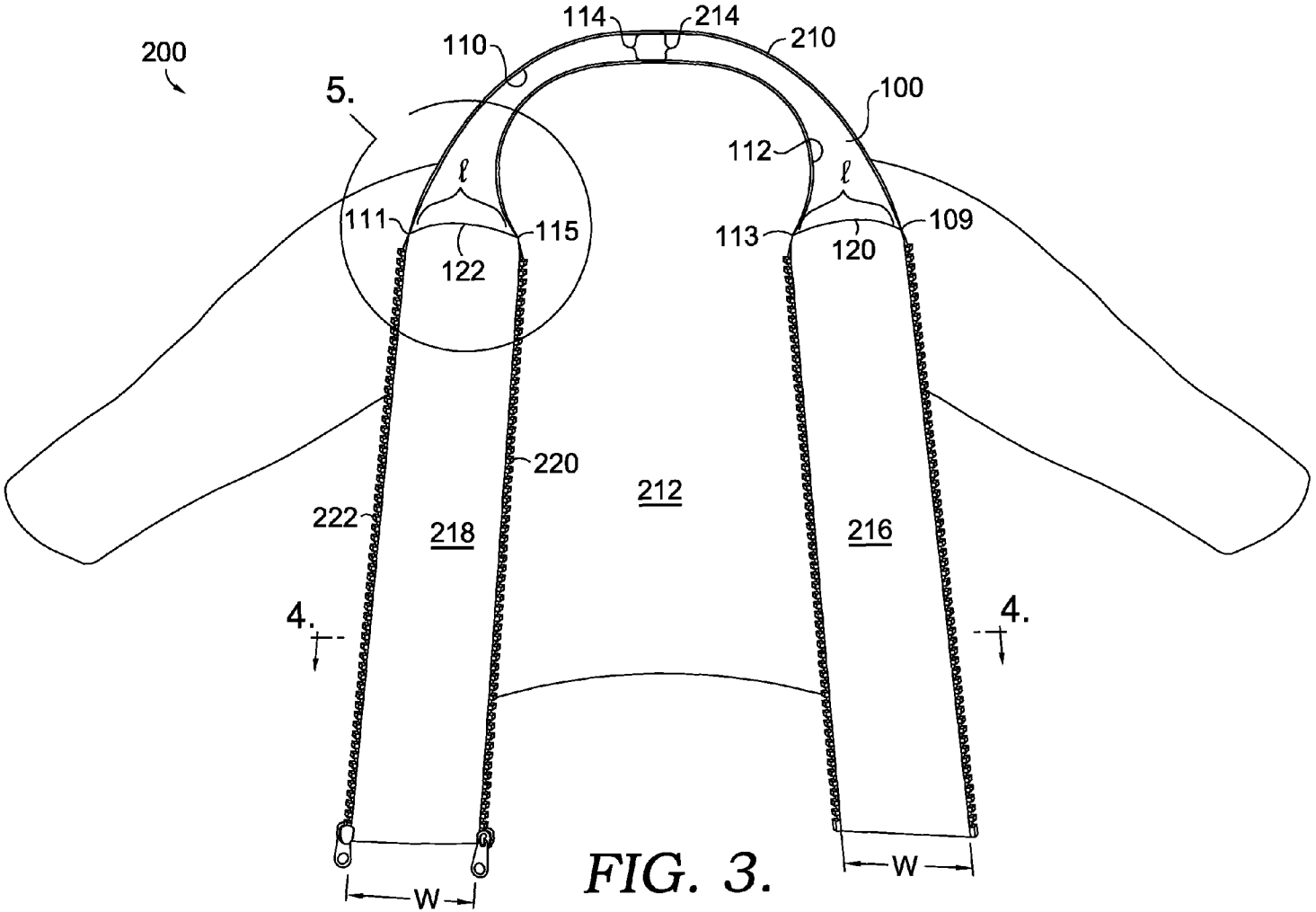
FIG. 3 illustrates a front plan view of an exemplary apparel item depicting an exemplary relationship between a neckline gusset, an exterior shell layer, an inner liner layer, and center-front gussets of the exemplary apparel item for reference purposes in accordance with aspects thereof.

FIG. 3 illustrates a front plan view of an exemplary apparel item 200 in an as-constructed arrangement, in accordance with aspects hereof. FIG. 3 depicts an exemplary relationship between the neckline gusset 100 of FIG. 1, a neckline of an exterior shell layer 210 of the apparel item 200, a neckline of an inner liner layer 212 of the apparel item 200, and center-front gussets 216 and 218 of the apparel item 200 when the apparel item 200 is in the as-constructed arrangement. The dimensions depicted in FIG. 3 are meant to be illustrative and not limiting.

As depicted in FIG. 3, the two front portions of the inner liner layer 212 are positioned to be secured together by a zipper mechanism 220, and the two front portions of the exterior shell layer 210 are positioned to be secured together by a second zipper mechanism 222. Although a zippered mechanism is depicted in FIG. 3, it is contemplated that additional mechanisms may be used to secure the front portions of the apparel item 200 such as, for example, buttons, snap closures, hook-and-loop fasteners, and the like. The outer-facing surfaces (the surface facing away from the wearer's trunk when the apparel item 200 is worn) of the center-front gussets 216 and 218 are visible.

The apparel item 200 in one aspect may comprise an outerwear assembly such as a jacket or a coat that covers at least the front torso, the back torso, and the shoulders of a wearer. Although the apparel item 200 is shown as having sleeves, it is contemplated that the apparel item 200 may also be in the form of a vest. The apparel item 200 may further include one or more panels extending from the neckline of the exterior shell layer 210 and/or from the neckline of the inner liner layer 212. For example, although not shown in FIG. 3, a hood or collar panel may extend from the neckline of the exterior shell layer 210, and/or a collar panel may extend from the neckline of the inner liner layer 212. Any and all such variations, and any combination thereof, are contemplated to be within the scope contemplated herein.

Further, although only one inner liner layer is depicted, it is contemplated that the apparel item 200 may comprise more than one liner layer. Spaces are shown between the neckline gusset 100 and the neckline of the exterior shell layer 210 and the neckline of the inner liner layer 212 to better illustrate positional relationships between these different elements. In reality, there would be minimal to no space between the neckline gusset 100, the neckline of the exterior shell layer 210, and the neckline of the inner liner layer 212 when the apparel item 200 is in the as-constructed arrangement.

In aspects hereof, the outer edge 110 of the neckline gusset 100 may be permanently affixed or secured to the neckline of the exterior shell layer 210 by, for example, stitching, adhesives, bonding, and the like. In other aspects hereof, the outer edge 110 may be removably affixed to the neckline of the exterior shell layer 210 by, for instance, buttons, zippers, snap closures, hook-and-loop fasteners, and the like. Likewise, the inner edge 112 of the neckline gusset 100 may be permanently affixed to the neckline of the inner liner layer 212 in some aspects by the use of stitching, bonding, adhesives, and the like. In other aspects hereof, the inner edge 112 may be removably affixed to the neckline of the inner liner layer 212 by the use of zippers, buttons, snap closures, hook-and-loop fasteners, and the like. Continuing, the center-front gusset edges 120 and 122 may be permanently or removably secured to the center-front gussets 216 and 218 using the affixing technologies described herein. Although the specific type of affixing technology used to secure the different edges of the apparel item 200 is not shown in FIG. 3, it is understood that FIG. 3 is meant to encompass any of the aforementioned types of affixing technologies.

As illustrated in FIG. 3, the shape of the outer edge 110 may minor the shape of the neckline of the exterior shell layer 210. In other words, both the neckline of the exterior shell layer 210 and the shape of the outer edge 110 may generally be in the form of a semi-circle. As well, the shape of the inner edge 112 may correspond to the shape of the neckline of the inner liner layer 212. Both the inner edge 112 and the neckline of the inner liner layer 212 may be generally C-shaped. Because of this configuration, the distance 114 between the outer edge 110 and the inner edge 112 taken at a midline of the neckline gusset 100 may be generally equal to a distance 214 between the neckline of the exterior shell layer 210 and the neckline of the inner liner layer 212 at the midline of the apparel item 200 (keeping in mind that the artificial spacing shown in FIG. 3 may make it appear that the distance 214 is greater than the distance 114). The result of the outer edge 110 minoring the shape of the neckline of the exterior shell layer 210, the inner edge 112 mirroring the shape of the neckline of the inner liner layer 212, and the distance 114 being equal to the distance 214, is that the exterior shell layer 210, the neckline gusset 100, and the inner liner layer 212 lay appropriately against the neckline of the wearer when the front portions of the apparel item 200 are secured together.

As mentioned, the center-front gussets 216 and 218 may be secured to the first and second center-front gusset edges 120 and 122. In order for the center-front gussets 216 and 218 to fold inwardly and lay without bunching or gathering when both the inner liner layer 212 and the exterior shell layer 210 of the apparel item 200 are closed along the front, the length of the first and second center-front gusset edges 120 and 122 measured from, for example, the terminal ends of the outer edge 110 of the neckline gusset 100 to the terminal ends of the inner edge 112 of the neckline gusset 100 (indicated in FIG. 3 by the letter "l") may be configured to match the width of the gussets 216 and 218, indicated by the letter "W" in FIG. 3. In one exemplary aspect, the width, W, of the gussets 216 and 218 and the length, l, of the center-front gusset edges 120 and 122 may both be between 13 and 15 centimeters.

To achieve the requisite length, l, the center-front gusset edges 120 and 122 are configured to curve inwardly into the body of the neckline gusset 100. A consequence of this is that the acute angles 124, 126, 128, and 130 discussed above with respect to FIGS. 1 and 2 are created between the center-front gusset edges 120 and 122 and the outer and inner edges 110 and 112. The length of the center-front gusset edges 120 and 122 matching the width of the center-front gussets 216 and 218, and the formation of the acute angles due to the inwardly-curved shape of the center-front gusset edges 120 and 122 combine to facilitate the center-front gussets 216 and 218 to fold inwardly and lay without bunching when the inner liner layer 212 and the exterior shell layer 210 of the apparel item 200 are both closed.

When the apparel item 200 is in a closed arrangement, the neckline gusset 100 in combination with the center-front gussets 216 and 218 help to create a substantially sealed volume between the inner liner layer 212 and the exterior shell layer 210. This is important for insulation and warmth purposes. In addition, because of the water-resistant/wind-resistant nature of the textile material used to construct the neckline gusset 100 and because the center-front gussets 216 and 218 are generally constructed from similar materials, the combination of the neckline gusset 100 and the center-front gussets 216 and 218 also helps to protect the wearer from the elements.

Figure 4:
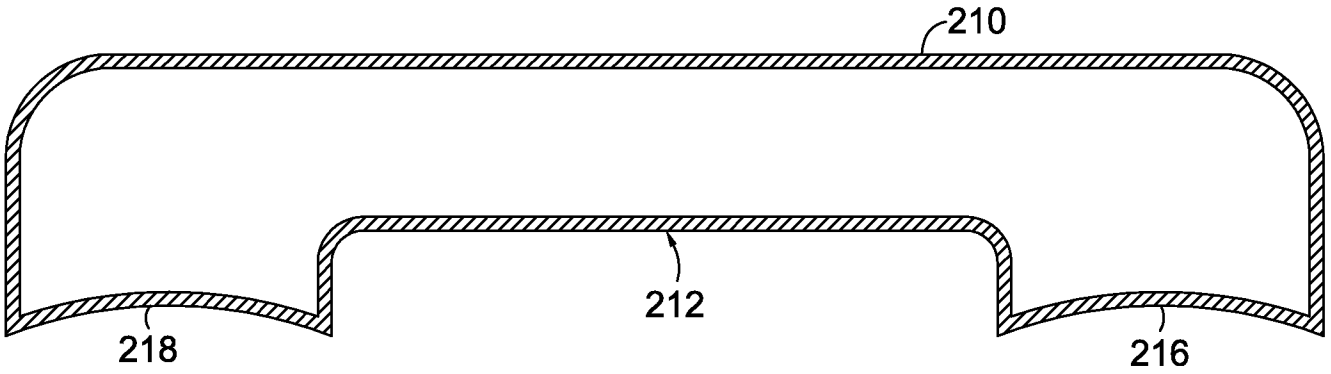
FIG. 4 is cross-sectional view taken along cut-line 4-4 of FIG. 3 illustrating the center-front gussets connecting the exterior shell layer with the inner liner layer for reference purposes in accordance with aspects thereof.

FIG. 4 depicts a cross-sectional view of the apparel item 200 taken along cut line 4-4 of FIG. 3 and illustrates how the center-front gussets 216 and 218 are used to secure the inner liner layer 212 of the apparel item 200 to the exterior shell layer 210 of the apparel item 200 at front portions of the apparel item 200, in accordance with aspects hereof. The elements depicted in FIG. 4 are not drawn to scale but generally depicted for illustration purposes.

Figure 5:
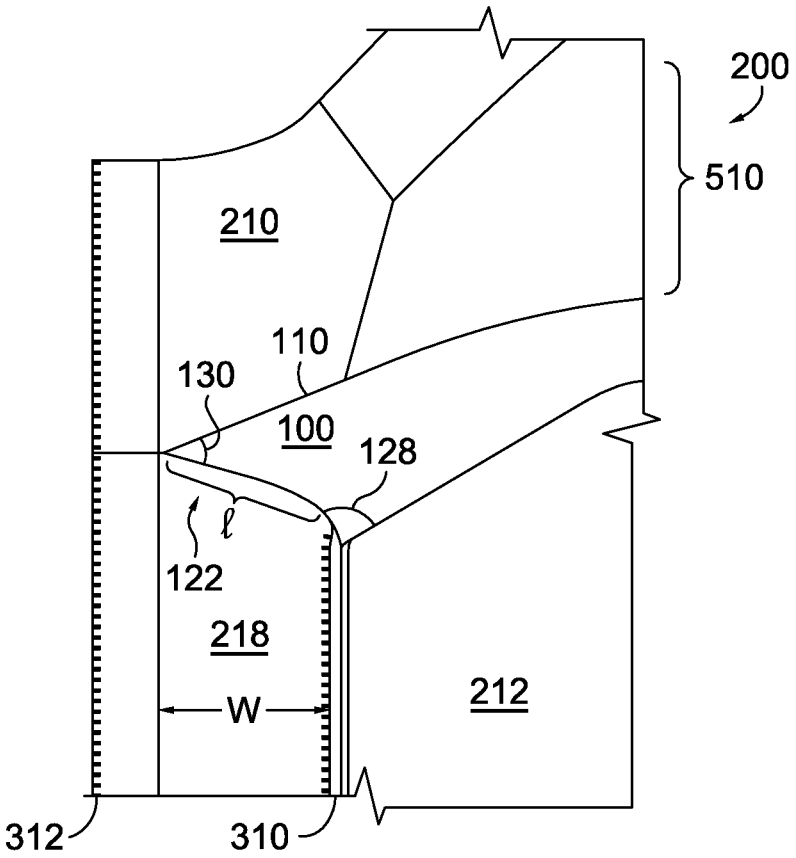
FIG. 5 illustrates a front plan view of a portion of the apparel item of FIG. 3 taken at the indicated circle depicting a neckline gusset, a center front gusset, an exterior shell layer, and an inner liner layer for reference purposes in accordance with aspects thereof.

FIG. 5 illustrates a front plan view of a portion of the exemplary apparel item 200 of FIG. 3 taken at reference circle 5, in accordance with aspects hereof. The front plan view depicts an inner-facing surface of the exterior shell layer 210 (the surface adjacent to the wearer's trunk when the apparel item 200 is worn), an inner-facing surface of the inner liner layer 212, the neckline gusset 100, and the center-front gusset 218. Although not shown in FIG. 5, the outer-facing surface of the inner liner layer 212 is adjacent to the inner-facing surface of the exterior shell layer 210.

As seen in FIG. 5, the center-front gusset 218 may connect an edge 310 of the inner liner layer 212 with an edge 312 of the exterior shell layer 210 along a front portion of the apparel item 200. Although zippers are depicted as being associated with the inner liner layer 212 and the exterior shell layer 210 in FIG. 5, it is contemplated that additional mechanisms may be used to secure the front portions of the apparel item 200 such as, for example, buttons, snap closures, hook-and-loop fasteners, and the like. As mentioned, the width of the center-front gusset, W, taken from the edge 310 to the edge 312 may be approximately 13-15 centimeters. This width enables the exterior shell layer 210 to lay comfortably open without having to open the inner liner layer 212.

As shown in FIG. 5, the neckline gusset 100 connects the inner liner layer 212 with the exterior shell layer 210 at a neckline region of the apparel item 200. For instance, the outer edge 110 of the neckline gusset 100 is connected to the inner-facing surface of the exterior shell layer 210. As well, the inner edge 112 of the neckline gusset 100 is connected to the neckline of the inner liner layer 212. FIG. 5 further illustrates a collar panel 510 extending from the neckline of the exterior shell layer 210. Although not shown, an additional collar panel may extend from the neckline of the inner liner layer 212. The center-front gusset edge 122 is connected to the center-front gusset 218. As discussed above, the length, l, of the center-front gusset edge 122 is generally equal to the width, W, of the center-front gusset 218. Acute angles, such as the acute angle 128 and 130 of FIGS. 1 and 2, are formed at the junction of the center-front gusset edge 122 and the inner edge 112 and the outer edge 110 respectively. As described, this configuration facilitates the center-front gusset 218 to fold inwardly and lay without bunching when the apparel item 200 is closed along the front.

Many different arrangements of the various elements depicted, as well as elements not shown, are possible without departing from the scope of the claims below. Aspects of our technology have been described with the intent to be illustrative rather than restrictive. Alternative aspects will become apparent to readers of this disclosure after and because of reading it. Alternative means of implementing the aforementioned can be completed without departing from the scope of the claims below. Certain features and subcombinations are of utility and may be employed without reference to other features and subcombinations and are contemplated within the scope of the claims.

What is claimed is:

1. A neckline gusset for connecting an exterior shell layer of an apparel item to an inner liner layer of the apparel item at a neckline region of the apparel item, the neckline gusset comprising:

a textile material having:

an outer edge adapted to secure the neckline gusset to a portion of the exterior shell layer of the apparel item at the neckline region;

an inner edge adapted to secure the neckline gusset to a portion of the inner liner layer of the apparel item at the neckline region;

a first center-front gusset edge connecting the outer edge with the inner edge at a first end of the neckline gusset and adapted to secure the neckline gusset to a first center-front gusset located between the inner liner layer and the exterior shell layer at a first front portion of the apparel item, the first center-front gusset edge having a first curved shape such that a first acute angle is formed between the outer edge and the first center-front gusset edge and a second acute angle is formed between the inner edge and the first center-front gusset edge; and a second center-front gusset edge connecting the outer edge with the inner edge at a second end of the neckline gusset and adapted to secure the neckline gusset to a second center-front gusset located between the inner liner layer and the exterior shell layer at a second front portion of the apparel item, the second center-front gusset edge having a second curved shape such that a third acute angle is formed between the outer edge and the second center-front gusset edge and a fourth acute angle is formed between the inner edge and the second center-front gusset edge.

2. The neckline gusset of claim 1, wherein the outer edge is permanently secured to the portion of the exterior shell layer.

3. The neckline gusset of claim 1, wherein the inner edge is permanently secured to the portion of the inner liner layer.

4. The neckline gusset of claim 1, wherein the first center-front gusset edge is permanently secured to the first center-front gusset.

5. The neckline gusset of claim 1, wherein the second center-front gusset edge is permanently secured to the second center-front gusset.

6. The neckline gusset of claim 1, wherein the first curved shape is the same as the second curved shape.

7. The neckline gusset of claim 1, wherein the first and third acute angles measure the same number of degrees.

8. The neckline gusset of claim 7, wherein the first and third acute angles each measure between 30 to 40 degrees.

9. The neckline gusset of claim 1, wherein the second and fourth acute angles measure the same number of degrees.

10. The neckline gusset of claim 9, wherein the second and fourth acute angles each measure between 10 to 20 degrees.

11. An enhanced mobility outerwear assembly comprising:

an exterior shell layer having an outer-facing surface, an inner-facing surface, and a neckline having a first shape configuration, the exterior shell layer adapted to cover at least the front torso, the back torso, and the shoulders of a wearer;

an inner liner layer having an outer-facing surface, an inner-facing surface, and a neckline having a second shape configuration, the inner liner layer adapted to cover at least the front torso, the back torso, and the shoulders of the wearer, the outer-facing surface of the inner liner layer disposed adjacent to the inner-facing surface of the exterior shell layer;

a first center-front gusset that connects the exterior shell layer with the inner liner layer along a first front portion of the outerwear assembly;

a second center-front gusset that connects the exterior shell layer with the inner liner layer along a second front portion of the outerwear assembly;

a neckline gusset that connects the exterior shell layer with the inner liner layer at a neckline region of the outerwear assembly, the neckline gusset comprising a textile material having:

an outer edge having a shape corresponding to the first shape configuration of the neckline of the exterior shell layer, the outer edge adapted to secure the neckline gusset to the neckline of the exterior shell layer;

an inner edge having a shape corresponding to the second shape configuration of the neckline of the inner liner layer, the inner edge adapted to secure the neckline gusset to the neckline of the inner liner layer;

a first center-front gusset edge connecting the outer edge with the inner edge at a first end of the neckline gusset and adapted to secure the neckline gusset to the first center-front gusset, the first center-front gusset edge having a first curved shape such that a first acute angle is formed between the outer edge and the first center-front gusset edge and a second acute angle is formed between the inner edge and the first center-front gusset edge; and a second center-front gusset edge connecting the outer edge with the inner edge at a second end of the neckline gusset and adapted to secure the neckline gusset to the second center-front gusset, the second center-front gusset edge having a second curved shape such that a third acute angle is formed between the outer edge and the second center-front gusset edge and a fourth acute angle is formed between the inner edge and the second center-front gusset edge.

12. The outerwear assembly of claim 11, wherein the neckline gusset is constructed from a water-resistant material.

13. The outerwear assembly of claim 11, wherein the first shape configuration of the neckline of the exterior shell layer comprises a generally semi-circular shape.

14. The outerwear assembly of claim 13, wherein the second shape configuration of the neckline of the inner liner layer comprises a generally C-shaped curve.

15. The outerwear assembly of claim 11, wherein the length of the first center-front gusset edge is equal to the width of the first center-front gusset, and wherein the length of the second center-front gusset edge is equal to the width of the second center-front gusset.

16. The outerwear assembly of claim 15, wherein the length of the first center-front gusset edge, the width of the first center-front gusset, the length of the second center-front gusset edge, and the width of the second center-front gusset are each between 13 to 15 centimeters.

17. A neckline gusset for connecting an exterior shell layer of an apparel item with an inner liner layer of the apparel item at a neckline region of the apparel item, the neckline gusset comprising:

a textile material having:

an outer edge adapted to secure the neckline gusset to a portion of a neckline of the exterior shell layer of the apparel item, the outer edge terminating at a first end and a second end of the neckline gusset;

an inner edge adapted to secure the neckline gusset to a portion of a neckline of the inner liner layer of the apparel item, the inner edge terminating at the first end and the second end of the neckline gusset;

a first center-front gusset edge connecting the outer edge with the inner edge at the first end of the neckline gusset and adapted to secure the neckline gusset to a first center-front gusset located between the inner liner layer and the exterior shell layer at a first front portion of the apparel item, the first center-front gusset edge having an inwardly-curved shape; and a second center-front gusset edge connecting the outer edge with the inner edge at the second end of the neckline gusset and adapted to secure the neckline gusset to a second center-front gusset located between the inner liner layer and the exterior shell layer at a second front portion of the apparel item, the second center-front gusset edge having an inwardly-curved shape, wherein a first acute angle is formed between the first and second center-front gusset edges and the outer edge and a second acute angle is formed between the first and second center-front gusset edges and the inner edge.

18. The neckline gusset of claim 17, wherein the textile material comprises at least one of woven or knitted nylon or polyester.

19. The neckline gusset of claim 17, wherein the textile material is water-resistant.

20. The neckline gusset of claim 17, wherein the first acute angle measures a greater number of degrees than the second acute angle.

* * * * *